United States Patent [19]

Magin

[11] Patent Number: 4,741,184

[45] Date of Patent: May 3, 1988

[54] LAUNDRY PRESS

[75] Inventor: Berthold Magin, Hassloch/Pfalz, Fed. Rep. of Germany

[73] Assignee: MTM Obermaier GmbH & Co., KG

[21] Appl. No.: 730,330

[22] Filed: May 3, 1985

[30] Foreign Application Priority Data

May 4, 1984 [DE] Fed. Rep. of Germany ..... 3416458
Sep. 11, 1984 [DE] Fed. Rep. of Germany ... 8426718[U]

[51] Int. Cl.[4] ..... D06F 15/00

[52] U.S. Cl. ..... 68/210; 68/242; 100/116; 100/211; 100/226

[58] Field of Search ..... 100/116, 127, 211, 226; 68/210, 242

[56] References Cited

U.S. PATENT DOCUMENTS

| | | | |
|---|---|---|---|
| 2,685,189 | 8/1954 | Watson | 100/211 X |
| 2,955,452 | 10/1960 | Meyers | 68/242 |
| 3,478,909 | 11/1969 | Charles | 100/211 X |
| 3,899,835 | 8/1975 | Meyer | 68/210 X |
| 3,908,413 | 9/1975 | Meyer | 68/242 |
| 3,924,425 | 12/1975 | Arendt | 68/242 |
| 3,968,282 | 7/1976 | Engel | 100/211 X |
| 4,019,984 | 4/1977 | Mohn | 100/116 X |
| 4,101,285 | 7/1978 | Tilby | 100/116 X |
| 4,149,393 | 4/1979 | Unlyarik | 68/210 |
| 4,163,420 | 8/1979 | Sercombe | 100/226 X |
| 4,249,400 | 2/1981 | Arendt | 68/242 |
| 4,452,056 | 6/1984 | Files | 100/211 |

FOREIGN PATENT DOCUMENTS

| | | | |
|---|---|---|---|
| 2801200 | 7/1979 | Fed. Rep. of Germany | 68/242 |
| 3307229 | 9/1984 | Fed. Rep. of Germany | 61/242 |

*Primary Examiner*—Harvey C. Hornsby
*Assistant Examiner*—Frankie L. Stinson
*Attorney, Agent, or Firm*—Toren, McGeady & Associates

[57] ABSTRACT

A laundry press includes an approximately hemispherical, circumferentially perforated pressing basket and a cover which is placeable on the basket in a pressure-tight manner. A diaphragm is mounted on the cover. A pressure medium can be introduced in the space between cover and diaphragm. The water pressed out of the laundry is collected and discharged from a vessel. The cover and the pressing basket are displaceable independently from one another. The pressure medium is introduced initially by means of a quickly delivering pump and the actual pressure for pressing out the laundry is provided by a piston pump.

17 Claims, 2 Drawing Sheets

LAUNDRY PRESS

BACKGROUND OF THE INVENTION

The present invention relates to a laundry press including a perforated press basket, a cover which can be placed on the basket, and an elastic diaphragm mounted in the cover. The press further includes a device for conducting a pressure medium into the space defined between the cover and the diaphragm, and a vessel for collecting and conducting away the water pressed out of the laundry.

Laundry presses of this type are known. For example, German Pat. No. 561,177 shows a cylindrical container having a perforated bottom, a cover which can be placed on the cylinder, and a rubber diaphragm fastened on the inside of the cover. The space between the cover and the rubber diaphragm can be pressurized by means of an air pump on the cover, so that the water contained in the laundry can be pressed out.

German Pat. No. 648,293 shows a spherical container and a rubber diaphragm fastened in the equatorial plane of the container. In this spherical laundry press, only the cover is perforated and has a water discharge channel. The pressure required for pressing out the laundry is generated by means of pressurized water.

At the present time, a laundry press operating in two stages is used commercially. This laundry press includes a perforated container in which the laundry arriving from the washing machine is initially mechanically pressed by means of a plunger. Subsequently, the container is removed and the compressed laundry is conveyed to the next processing station where a bell-shaped cover is placed over the compressed laundry which has been put onto a perforated bottom. An elastic diaphragm is mounted in the interior of the cover. This diaphragm applies the actual pressure for pressing out the laundry.

This laundry press has the disadvantage that it operates in two stages and that the bundle of compressed laundry may open on its way from the first pressing station to the second pressing station, so that pieces of the laundry may be clamped in the sealing surface between the bell-shaped cover and the bottom, which may lead to damage.

In another laundry press which is used commercially at present, a cylindrical container has a perforated bottom. The bottom is elastic to compensate for non-uniform distribution of the laundry in the container. The laundry is pressed out mechanically by means of a piston.

In a second stage, compressed air is conducted through the mechanically drained laundry in order to force out additional water. This press may easily crease or even damage the laundry. In addition, the compressed air which is conducted through the laundry must be pre-filtered and disinfected.

Another disadvantage of the known laundry presses resides in that individual pieces of laundry remain adhering to the wall of the pressing basket when unloading the laundry batch. Experience has shown that the adherence is greatest when the wall of the pressing basket is smooth. It is then necessary to remove these pieces of laundry by hand.

Therefore, it is the primary object of the present invention to provide a laundry press of the type described above which operates in one stage, can be easily loaded and unloaded, has a high drainage efficiency, and prevents damage to the laundry.

SUMMARY OF THE INVENTION

In accordance with the present invention, the pressing basket of the laundry press can be displaced about an axis which is independent from the cover. The pressing basket can be emptied by displacing it. In addition, the device for introducing pressure medium comprises a first rapidly delivering pump and second pump which generates pressure.

The laundry press in accordance with the present invention has the advantage that time and space are saved because the pressing procedure takes place in one stage. Further advantages of the invention are that the laundry is treated very carefully, that the space between cover and diaphragm can be filled very rapidly with the amount of pressure medium required by the size of the laundry batch in the pressing basket, and that it is possible in a simple and safe manner to generate the high pressure required for the high drainage efficiency.

In known laundry presses, a single pump, i.e., either a centrifugal pump or an impeller-type pump, is used for filling the space between cover and diaphragm with the required amount of pressure medium and for generating the pressing pressure. However, these pumps are, in principle, not well suited for generating high pressures and, therefore, are subjected to great wear.

For this reason, it is advantageous to use for the first pump a centrifugal pump or impeller-type pump, and a piston pump as the second pump.

In accordance with a further advantageous development of the invention, the cover can be displaced about a cover pivot axis. As a result, the pressing basket and cover can be displaced independently from one another, which has a favorable effect on the operation of the laundry press.

In a first embodiment of the invention, the axes of the basket and cover extend horizontally and coaxially to one another. In this case, the pressing basket is displaced by 180° for emptying the compressed laundry after the cover has been displaced to the necessary extent.

In accordance with a further embodiment, the pivot axis of the cover extends vertically and the cover can be raised and lowered. This embodiment is of particular advantage if, in accordance with a further development, at least two pressing baskets are provided which are used with only one cover. In operation of this embodiment, one of the two pressing baskets contains the laundry batch to be drained at a particular time, while the other pressing basket, at the same time, empties out the already drained laundry and subsequently receives a new batch of laundry.

In order to prevent damage to pieces of laundry described above, another improvement of the invention provides that a flexible plate is provided in the pressing basket, which plate is pressed against the laundry batch as a result of the action of the diaphragm. The resulting advantage is that it is no longer possible that laundry pieces are clamped between the rim of the pressing basket and the diaphragm because the plate pushes down the laundry pieces of the uppermost layer of the laundry batch, while, on the other hand, irregularities in the filling of the pressing basket with laundry pieces can be easily compensated, so that all laundry pieces are pressed and drained uniformly.

The plate preferably is a planar plate. Particularly, the plate is of hard rubber and has a fabric insert.

In accordance with a further advantageous development of the invention, the plate and diaphragm are connected to one another at the center. This makes it possible to retract the flexible plate when the diaphragm is pulled back by the generation of a negative pressure in the space between the cover and the diaphragm, so that it is easily possible to empty the compressed laundry batch by displacing the pressing basket.

In accordance with another advantageous further development of the invention, the inner surface of the pressing basket has a coating of anti-clinging material. This coating forms a closed, smooth surface which has an anti-clinging effect with respect to the compressed laundry pieces and thereby prevents the pieces of laundry from clinging to the pressing basket.

Preferred materials for the anti-clinging coating are melamine resin or tetrafluoroethylene which are lacquered onto the inner surface of the pressing basket in the form of a thin layer.

In order to prevent excessive stretching of the elastic diaphragm, a projection may be provided on the inside of the cover. The projection can be inserted with an exact fit in the pressing basket and the diaphragm may be fastened at the free end of the projection. As a result, when the cover is closed, initially the laundry batch is mechanically pushed toward the bottom of the pressing basket before the diaphragm presses the laundry uniformly against the pressing basket.

Although a draining efficiency of more than 50% is achieved with the press working in a single stage, it may be desirable to obtain additional drainage. In order to avoid the disadvantages which occur when compressed air is used, it is suggested, in accordance with the present invention, to provide a bell which can be placed over the pressing basket and can be connected in a pressure-tight manner to the pressing basket. The space between bell and pressing basket can then be evacuated by means of a vacuum pump. This reduces in the known manner the boiling point of the water remaining in the compressed laundry, so that the moisture evaporates. Since this happens at a reduced temperature, damage to the laundry, which would occur at high temperatures, does not have to be expected.

In accordance with a further advantageous development, the bell may simultaneously serve as a vessel for catching and discharging the water which has been pressed out.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
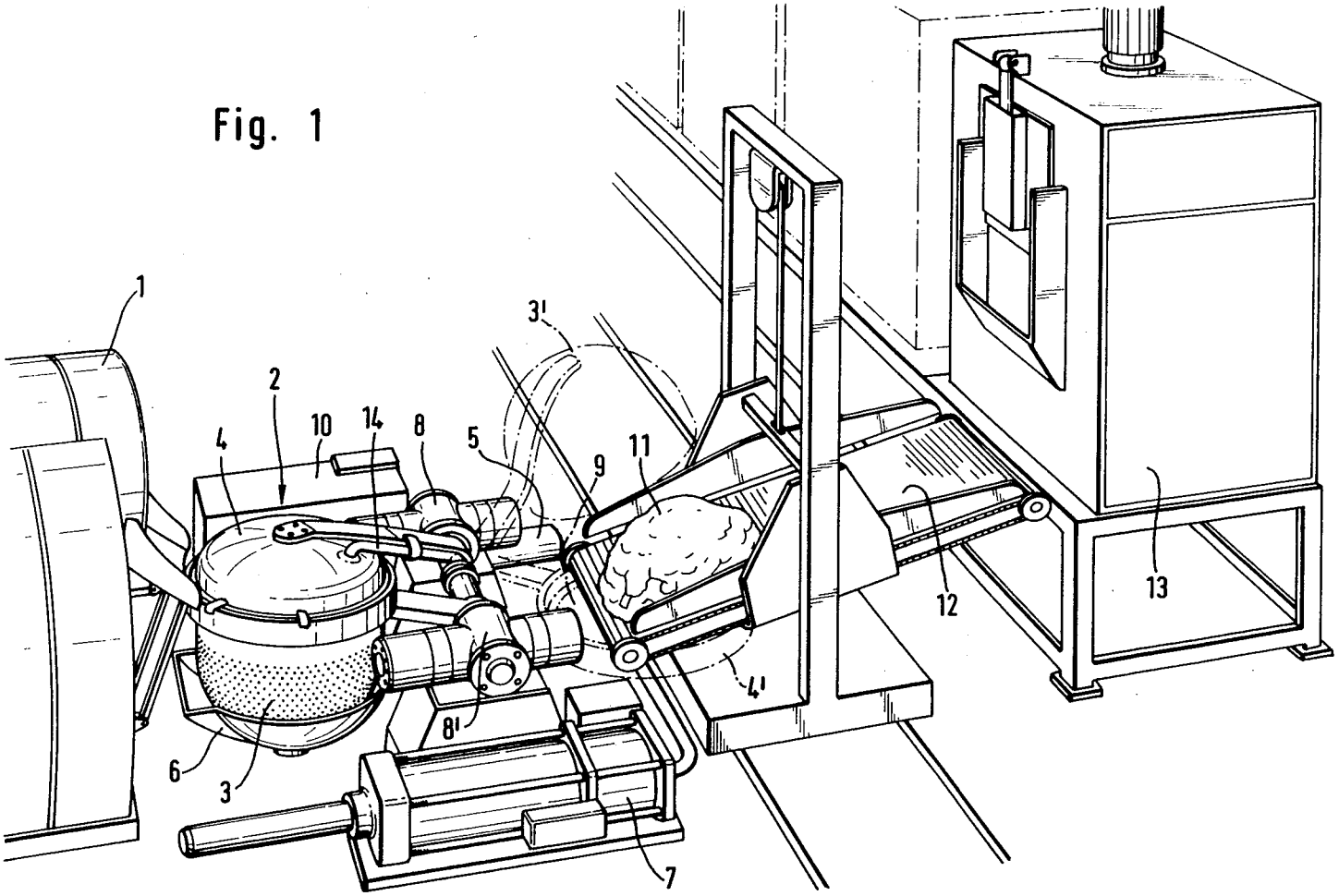
FIG. 1 is a perspective illustration of a laundry plant.

FIG. 1 of the drawing is a perspective illustration of a laundry plant. On the left-hand side is depicted a drum-type washing machine 1 from which the laundry is conducted over a chute directly into laundry press 2. After draining the laundry, the laundry batch 11 is conveyed to a tumbler 13 over a discharge conveyor band 12. The discharge conveyor band 12 is laterally movable on rails.

Laundry press 2 contains a hemispherical pressing basket 3 which is perforated over its circumference. A cover 4 can be placed on pressing basket 3. A line 14 for the pressure medium, such as water, leads into cover 4. Pressing basket 3 rests in a vessel 6 which catches and discharges the water pressed out of the laundry.

Cover 4 as well as pressing basket 3 can each be displaced by means of hydraulic drives. As illustrated in FIG. 1, the axes 8, 8' extend horizontally and coaxially.

In the position illustrated on the left-hand side, pressing basket 3 and cover 4 are in the filling and pressing position. The pressure medium conducted through line 14 into the space between cover 4 and diaphragm 9 is initially supplied by means of a centrifugal pump or impeller-type pump 5. As soon as the diaphragm has been extended to the extent that the laundry rests uniformly against the inner surface of the pressing basket 3, a hydraulically driven piston pump 7, shown in front of the laundry press, provides the required pressure. It is possible in this manner to produce pressures of 20 bars or more without subjecting the pump to great wear, as is the case in presently used systems.

As soon as the laundry is pressed out, the cover 4 is displaced through 180° toward the right by means of pivot unit 8. On the right-hand side of FIG. 1, cover 4' is shown in the opened position, so that the inside of the cover with diaphragm 9 is visible. Subsequently, the conveyor band 12 is moved into the illustrated position. The laundry batch 11 is discharged from the pressing basket 3' after having been moved into the discharging position by means of its pivot unit 8'.

A box 10 illustrated in the rear of pressing basket 3 and the cover 4 houses the hydraulic units.

Figure 2:
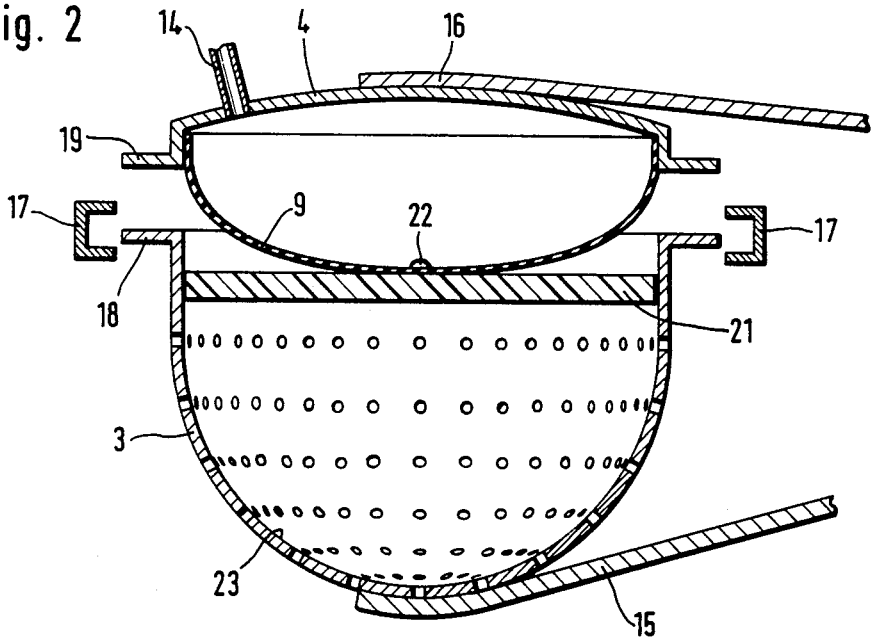
FIG. 2 is a sectional view of the laundry press shown in FIG. 1.

FIG. 2 shows a sectional view of the laundry press. Pressing basket 3 can be displaced by means of a support 15. The upper end of pressing basket 3 has a circumferential flange 18.

Cover 4 can also be displaced by means of a support 16. Cover 4 also has a circumferential flange 19. During the pressing procedure, the flanges 18, 19 are held together by means of clamps 17.

An elastic diaphragm 9 is fastened to the inside of cover 4. A pressure medium, such as water, can be filled into or discharged from the space between cover 4 and diaphragm 9 by means of a line 14.

A planar elastic plate 21 is connected by means of a fastening member 22 to the bottom side of diaphragm 9. This plate 21 fits without play into pressing basket 3. As soon as pressure has been generated in the space between cover 4 and diaphragm 9, diaphragm 9 rests against the upper side of plate 21 and presses the latter against the laundry batch (not shown) in the pressing basket 3. Since diaphragm 9 and the laundry do not come into direct contact, it is not possible that the expanding diaphragm 9 damages pieces of laundry. It is also not possible that the elastic diaphragm 9 can be punctured by sharp objects in the laundry, such as, screwdrivers, knives, tweezers, etc., which are frequently left in work clothing. Due to the high pressures involved, puncturing of the diaphragm would lead to its destruction.

As soon as the laundry batch has been pressed out sufficiently, the pressure medium is again removed through line 14 from the space between cover 4 and diaphragm 9. In doing so, diaphragm 9 is pulled back into the interior of the cover and takes with it plate 21 through connection 22.

To safely prevent the clinging of individual laundry pieces to the inner surface 12 of the pressing basket 3, the entire basket is provided with a smooth surface 23 having anti-clinging properties. For example, the surface 23 may be coated with polytetrafluoroethylene or with melamine resin.

Figure 3:
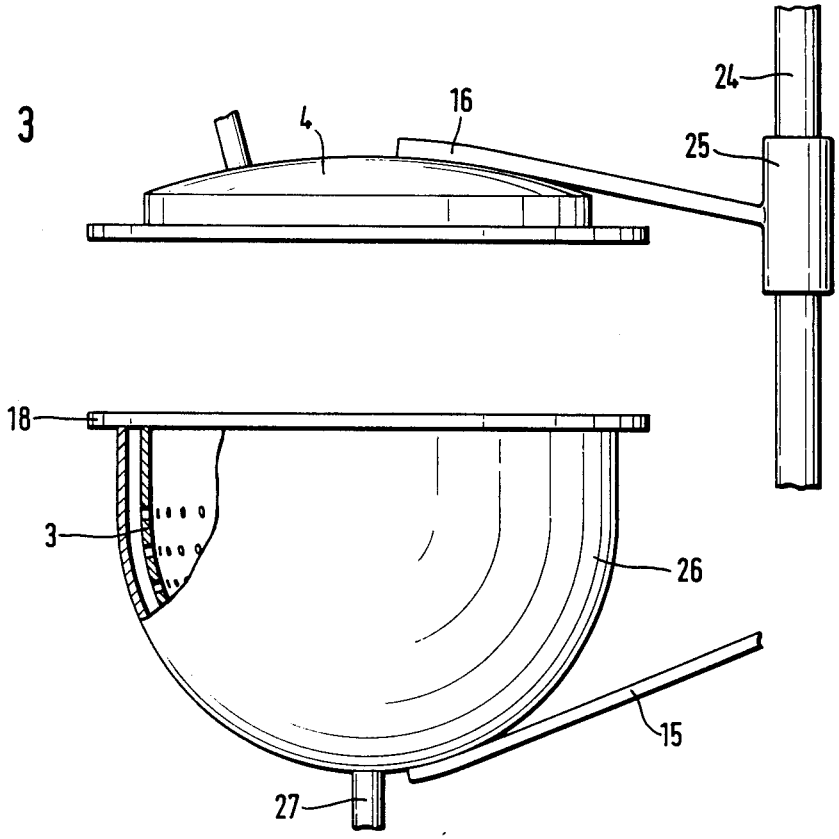
FIG. 3 is an elevational side view partly in section of a modified laundry press.

FIG. 3 of the drawing shows another embodiment of the laundry press. Cover 4 is fastened through its support 16 to a guide member 25 which is mounted on a shaft 24 so that it can be displaced and raised and lowered. This makes it possible to raise cover 4 and swing it to the side where it can be placed on another pressing basket, so that the laundry is drained in this basket while the first pressing basket is emptied.

Vessel 6 for catching the pressed-out water illustrated in FIG. 1 is modified in FIG. 3 to form a bell 26 which can be connected in a pressure-tight manner to the upper rim 18 of pressing basket 3. A vacuum pump connected to line 27 is used to obtain a vacuum in the space between bell 26 and pressing basket 3. This reduces the boiling point of the residual water still in the laundry, and this residual water is thus removed by evaporation.

While specific embodiments of the invention have been shown and described in detail to illustrate the application of the inventive principles, it will be understood that the invention may be embodied otherwise without departing from such principles.

I claim:

1. A laundry press comprising a perforated laundry basket for receiving laundry to be drained, a cover placeable on said basket, an elastic diaphragm mounted on said cover on the side facing said basket when said cover is placed on said basket, said cover and said basket forming a space therebetween, means for introducing a pressure medium into said space for exerting pressure on the laundry, said basket displaceable about an axis independently from said cover, said basket displaceable from a first position inside said vessel to a second position for emptying out the laundry, said basket being essentially hemispherical, a flexible plate placed in said basket, said plate being pressed against the laundry by said diaphragm when pressure medium is introduced into said space, said flexible plate capable of pressing against the laundry in such a way that damage to pieces of the laundry is prevented, and a vessel underneath said basket for collecting the water pressed out of the laundry, said vessel including means for discharging the water, said means for introducing pressure medium comprising a first pump for initially introducing said pressure medium at a high rate of delivery, and a second pump for generating the pressure exerted on the laundry.

2. The laundry press according to claim 1 wherein said cover is displaceable about an axis.

3. The laundry press according to claim 2 wherein said axes of said cover and said basket extend horizontally and coaxially to one another.

4. The laundry press according to claim 1 wherein said cover can be swung about a vertically extending axis and wherein said cover can be raised and lowered.

5. The laundry press according to claim 4 wherein said cover can be swung from said basket onto another basket.

6. The laundry press according to claim 1 wherein said plate is planar.

7. The laundry press according to claim 1 wherein said plate is of hard rubber and has a fabric insert.

8. The laundry press according to claim 1 wherein said plate and said diaphragm are connected to one another.

9. The laundry press according to claim 1 wherein the pressing basket has an inner surface coated with an anti-clinging material.

10. The laundry press according to claim 9 wherein said anti-clinging material is polytetrafluoroethylene.

11. The laundry press according to claim 9 wherein said anti-clinging material is melamine resin.

12. The laundry press according to claim 1 wherein said first pump is a centrifugal pump.

13. The laundry press according to claim 1 wherein said first pump is an impeller-type pump.

14. The laundry press according to claim 1 wherein said second pump is a piston pump.

15. The laundry press according to claim 1 wherein said cover has formed on its inside facing said basket a projection having a free end, said projection insertable in said pressing basket without play and said diaphragm fastened to said free end of said projection.

16. A laundry press comprising a perforated laundry basket for receiving laundry to be drained, a cover placeable on said basket, an elastic diaphragm mounted on said cover on the side facing said basket when said cover is placed on said basket forming a space therebetween, means for introducing a pressure medium into said space for exerting pressure on the laundry, said basket displaceable about an axis independently from said cover, said basket displaceable from a first position inside said vessel to a second position for emptying out the laundry, said basket being essentially hemispherical, a flexible plate placed in said basket, said plate being pressed against the laundry by said diaphragm when pressure medium is introduced into said space, said flexible plate capable of pressing against the laundry in such a way that damage to pieces of the laundry is prevented, a vessel underneath said basket for collecting the water pressed out of the laundry, said vessel including means for discharging the water, said means for introducing pressure medium comprising a first pump for initially introducing said pressure medium at a high rate of delivery, and a second pump for generating the pressure exerted on the laundry, wherein said vessel is a bell-shaped member placeable around said pressing basket and connectable to said pressing basket in a pressure-tight manner, and a vacuum pump for evacuating the space formed between said bell-shaped member and said pressing basket.

17. The laundry press according to claim 16 wherein said bell serves to collect and discharge the water pressed out of the laundry.

* * * * *